US011266206B2

(12) United States Patent
Chen

(10) Patent No.: US 11,266,206 B2
(45) Date of Patent: Mar. 8, 2022

(54) FASTENING DEVICE

(71) Applicant: Chin-Chu Chen, Taichung (TW)

(72) Inventor: Chin-Chu Chen, Taichung (TW)

( * ) Notice: Subject to any disclaimer, the term of this patent is extended or adjusted under 35 U.S.C. 154(b) by 182 days.

(21) Appl. No.: 16/558,181

(22) Filed: Sep. 2, 2019

(65) Prior Publication Data

US 2020/0337418 A1 Oct. 29, 2020

(30) Foreign Application Priority Data

Apr. 25, 2019 (TW) ..... 108114559

(51) Int. Cl.
*A43C 11/16* (2006.01)
*B65H 75/44* (2006.01)

(52) U.S. Cl.
CPC ..... *A43C 11/165* (2013.01); *B65H 75/4421* (2013.01); *B65H 75/4455* (2013.01); *B65H 75/4471* (2013.01); *B65H 75/4494* (2013.01)

(58) Field of Classification Search
CPC ..... A43C 11/165; B65H 75/4421; B65H 75/4455; B65H 75/4471; B65H 75/4494
See application file for complete search history.

(56) References Cited

U.S. PATENT DOCUMENTS 10,100,975 B2 10/2018 Chen
2007/0084956 A1* 4/2007 Chen ..... A43C 7/00 242/388.6
2011/0191992 A1* 8/2011 Chen ..... A43C 11/165 24/713.2
2012/0228419 A1* 9/2012 Chen ..... A43C 11/165 242/395
2014/0359981 A1 12/2014 Cotterman et al.
2015/0230560 A1* 8/2015 Chen ..... A43C 7/02 24/68 SK
2016/0120267 A1 5/2016 Burns et al.
2017/0082242 A1 3/2017 Chen
2017/0295888 A1 10/2017 Chen
2017/0304102 A1* 10/2017 Turrini ..... A61F 5/0111
2017/0325548 A1* 11/2017 Ha ..... A43C 7/00
2019/0000187 A1* 1/2019 Chen ..... A43C 7/00

(Continued)

FOREIGN PATENT DOCUMENTS

CN 202566580 U 12/2012
CN 204895922 U 12/2015
CN 206213402 U 6/2017

(Continued)

*Primary Examiner* — Sang K Kim
(74) *Attorney, Agent, or Firm* — CKC & Partners Co., LLC

(57) ABSTRACT

A fastening device including a case unit, a knob and an engaging unit is provided. The case unit includes a wall forming a receiving space and a plurality of mounting teeth. The knob covers on the case unit. The engaging unit is within the receiving space. The engaging unit corresponds to the mounting teeth and is selectively coupled to the knob. The knob is switched between a first position and a second position. When the knob is in the first position to couple to the engaging unit, the engaging unit is linked up with the knob and the engaging unit is engaged with the mounting teeth to prohibit the knob from rotating in a first direction, and when the knob is in the second position to disengage from the engaging unit, the engaging unit does not prohibit the knob from rotating in the first direction.

12 Claims, 10 Drawing Sheets

(56) References Cited

U.S. PATENT DOCUMENTS

| | | | | |
|---|---|---|---|---|
| 2019/0144150 | A1* | 5/2019 | Chen | A43C 11/165<br>100/32 |
| 2019/0150569 | A1* | 5/2019 | Chen | A43C 11/165 |

FOREIGN PATENT DOCUMENTS

| | | | |
|---|---|---|---|
| JP | 2017513679 | A | 6/2017 |
| JP | 2018509185 | A | 4/2018 |
| KR | 101040372 | B1 | 6/2011 |
| KR | 101661233 | B1 | 9/2016 |
| KR | 101688997 | B1 | 12/2016 |
| KR | 1020170021735 | A | 2/2017 |
| KR | 20170122462 | A | 11/2017 |
| KR | 1020190010579 | A | 1/2019 |
| WO | 2018137274 | A1 | 8/2018 |

* cited by examiner

FASTENING DEVICE

RELATED APPLICATIONS

This application claims priority to Taiwan Application Serial Number 108114559, filed Apr. 25, 2019, which is herein incorporated by reference.

BACKGROUND

Technical Field

The present disclosure relates to a fastening device. More particularly, the present disclosure relates to a fastening device for securing an article through loosening or tightening a lace.

Description of Related Art

In daily life, cords, such as a lace or a thread, are usually used to tighten articles. The most common tightening method is to use the cord to reciprocately pass through holes on the article, e.g., eyelets of a shoe, and then tie a knot to secure the article. But in this kind of tightening method, the knot is loosened easily owing to an external force. Not only does the knot need to be tied again, but also lots of inconveniences come owing to the insecurity of the articles.

In order to solve such problems, some practitioners developed a simple fastening mechanism including a case, an engaging unit and a spring. The case includes holes configured for the lace to pass therethrough. Through the reaction force between the spring and the engaging unit, the lace can be clamped between the engaging unit and the case so as to be fastened. The length of the lace can be changed by pressing the spring to change the position of the engaging unit. However, in such fastening mechanism, the restoring force of the spring is served as the securing force; thus, the lace is easily to be released owing to vibrations or an external force. In addition, the fastening mechanism has no space for receiving the lace, and the exposure of the lace may bring danger.

Therefore, some practitioners developed another kind of buckle which can be rotated to tighten the lace, and the lace can be received inside the buckle. Through the interference between components inside the buckle, the length of the lace as well as the tightness can be adjusted. However, the structure of the buckle is complex; as a result, the manufacturing cost is increased, and the buckle has assembly and repair difficulty.

Based on the above-mentioned problems, how to simplify the structure of the fastening device, reduce the manufacturing cost and maintain the securing capability becomes a pursuit target for practitioners.

SUMMARY

The present disclosure provides a fastening device including a case unit, a spool, a positioning shaft, a knob and an engaging unit. The case unit includes a wall forming a receiving space, a partition protruding radially from the wall to separate the receiving space into an upper chamber and a lower chamber, and a plurality of mounting teeth located at the upper chamber. The spool is located at the lower chamber and includes a flexible clamping portion. The positioning shaft is inserted into the spool to couple to the flexible clamping portion, and the positioning shaft has an axial direction. The knob covers on the case unit and is connected to the positioning shaft. The engaging unit is located at the upper chamber. The engaging unit corresponds to the mounting teeth and is selectively coupled to the knob. The knob is switched between a first position and a second position along the axial direction, and the positioning shaft is linked up with the knob. When the knob is in the first position to couple to the engaging unit, the engaging unit is engaged with one of the mounting teeth to prohibit the spool from rotating in a first direction, and when the knob is in the second position to disengage from the engaging unit, the engaging unit does not prohibit the spool from rotating in the first direction.

The present disclosure provides a fastening device including a case unit, a knob and an engaging unit. The case unit includes a wall forming a receiving space and a plurality of mounting teeth located at the wall and facing toward the receiving space. The knob covers on the case unit. The engaging unit is within the receiving space. The engaging unit corresponds to the mounting teeth and is selectively coupled to the knob. The knob is switched between a first position and a second position along an axial direction. When the knob is in the first position to couple to the engaging unit, the engaging unit is linked up with the knob and the engaging unit is engaged with one of the mounting teeth to prohibit the knob from rotating in a first direction, and when the knob is in the second position to disengage from the engaging unit, the engaging unit does not prohibit the knob from rotating in the first direction.

BRIEF DESCRIPTION OF THE DRAWINGS

The disclosure can be more fully understood by reading the following detailed description of the embodiments, with reference made to the accompanying drawings as follows.

DETAILED DESCRIPTION

It will be understood that when an element (or mechanism or module) is referred to as be "disposed on", "connected to" or "coupled to" another element, it can be directly disposed on, connected or coupled to the other one element, or it can be indirectly disposed on, connected or coupled to the other one element, that is, intervening elements may be present. In contrast, when an element is referred to as be "directly disposed on," "directly connected to" or "directly coupled to" another element, there are no intervening elements present.

In addition, the terms first, second, third, etc. is used herein to describe various elements or components, these elements or components should not be limited by these terms. Consequently, a first element or component discussed below could be termed a second element or component.

Figure 1:
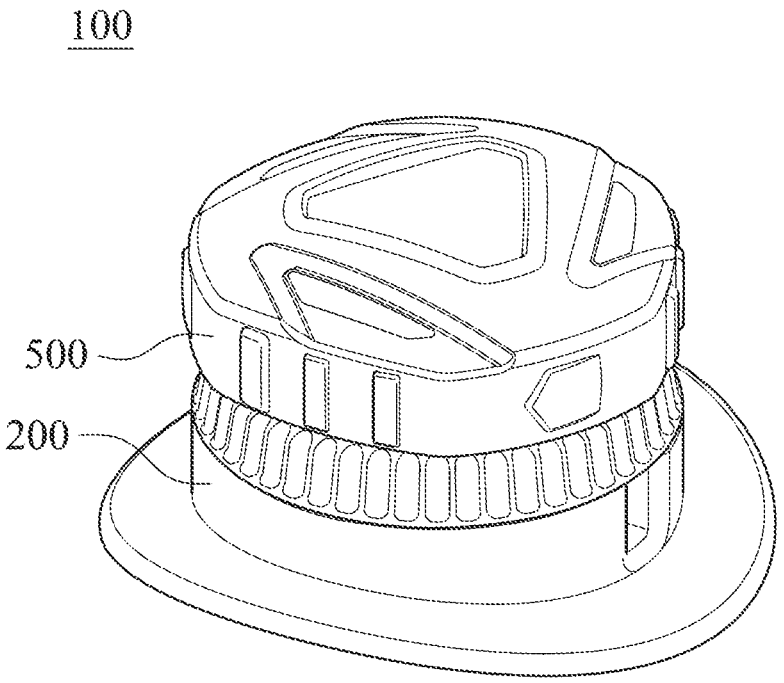
FIG. 1 shows a three dimensional schematic view of a fastening device according to one embodiment of the present disclosure.
Figure 2:
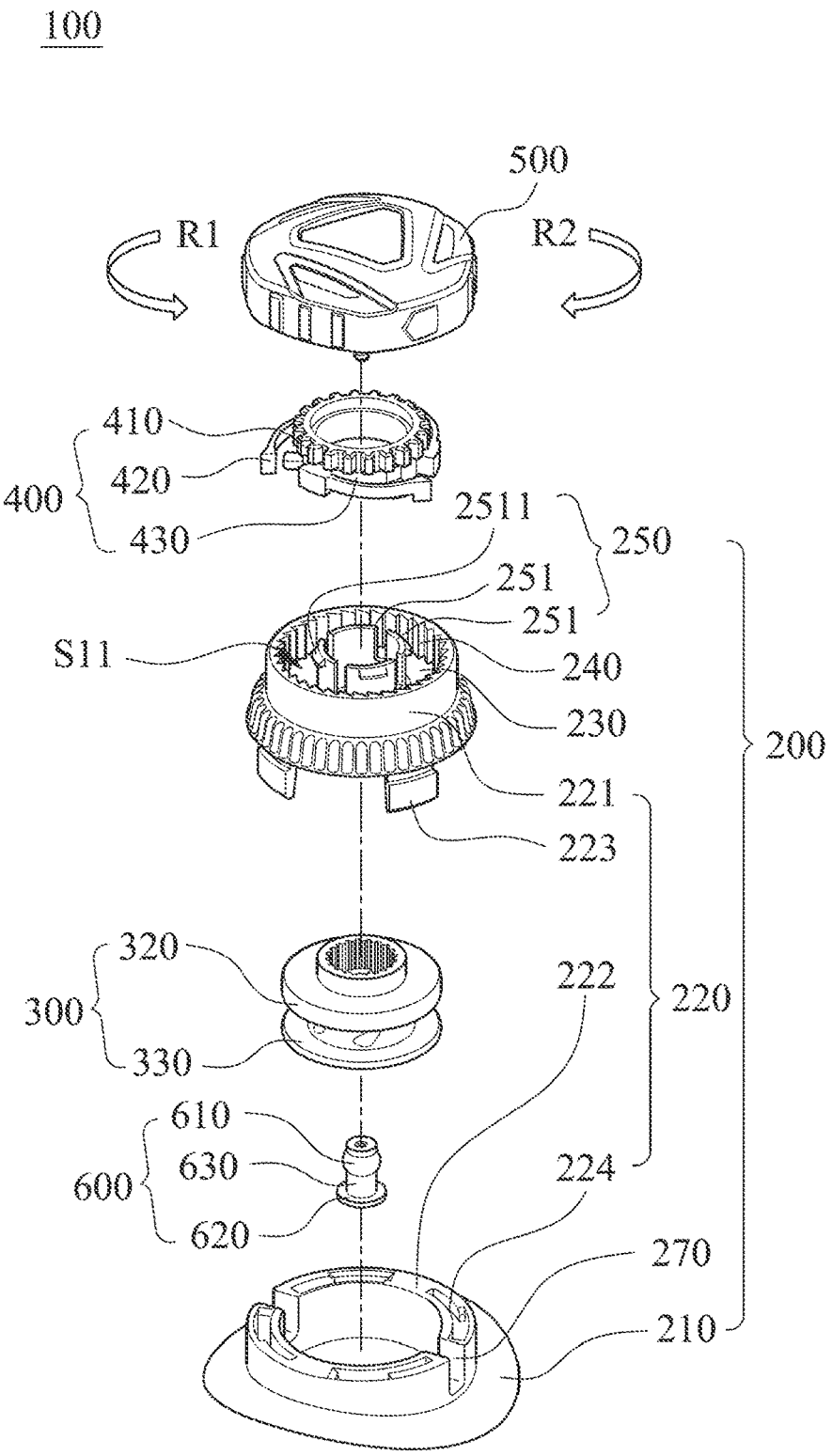
FIG. 2 shows one exploded view of the fastening device of FIG. 1.
Figure 3:
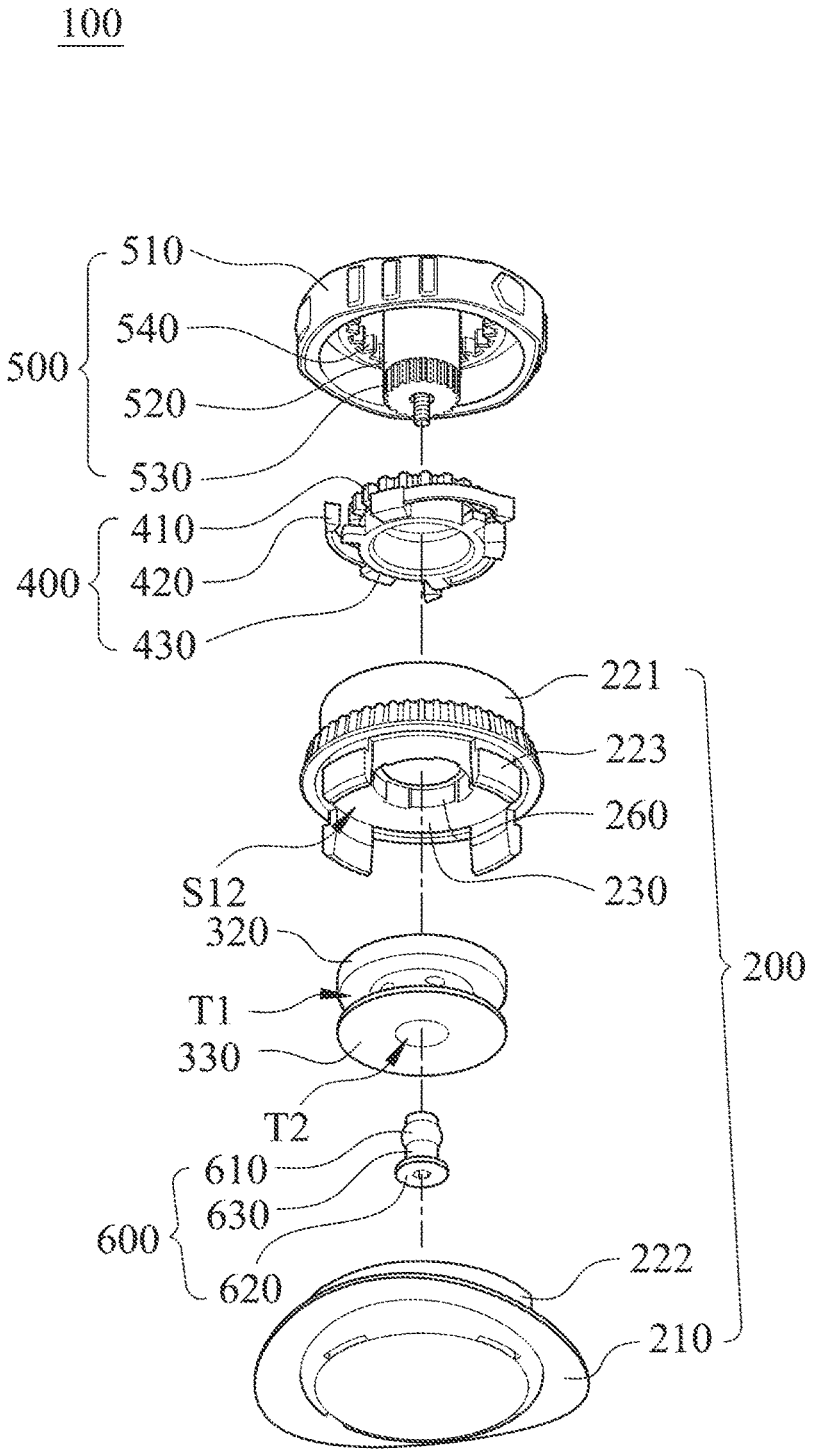
FIG. 3 shows another exploded view of the fastening device of FIG. 1.
Figure 4:
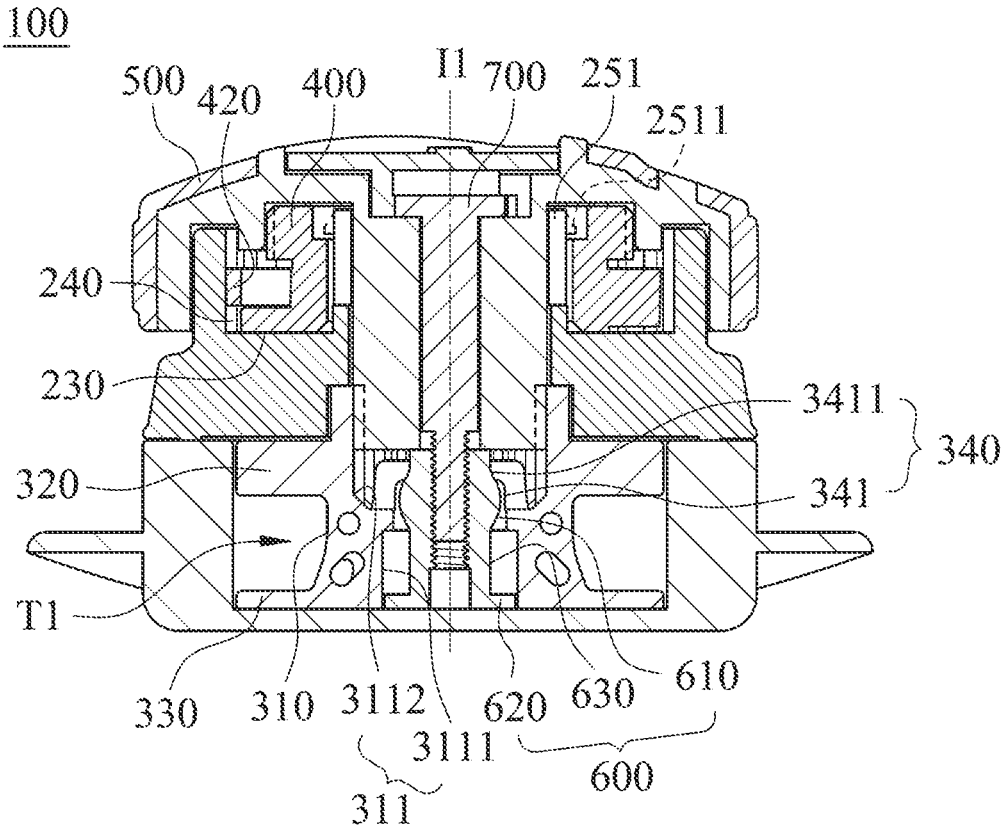
FIG. 4 shows one cross-sectional view of the fastening device of FIG. 1.
Figure 5:
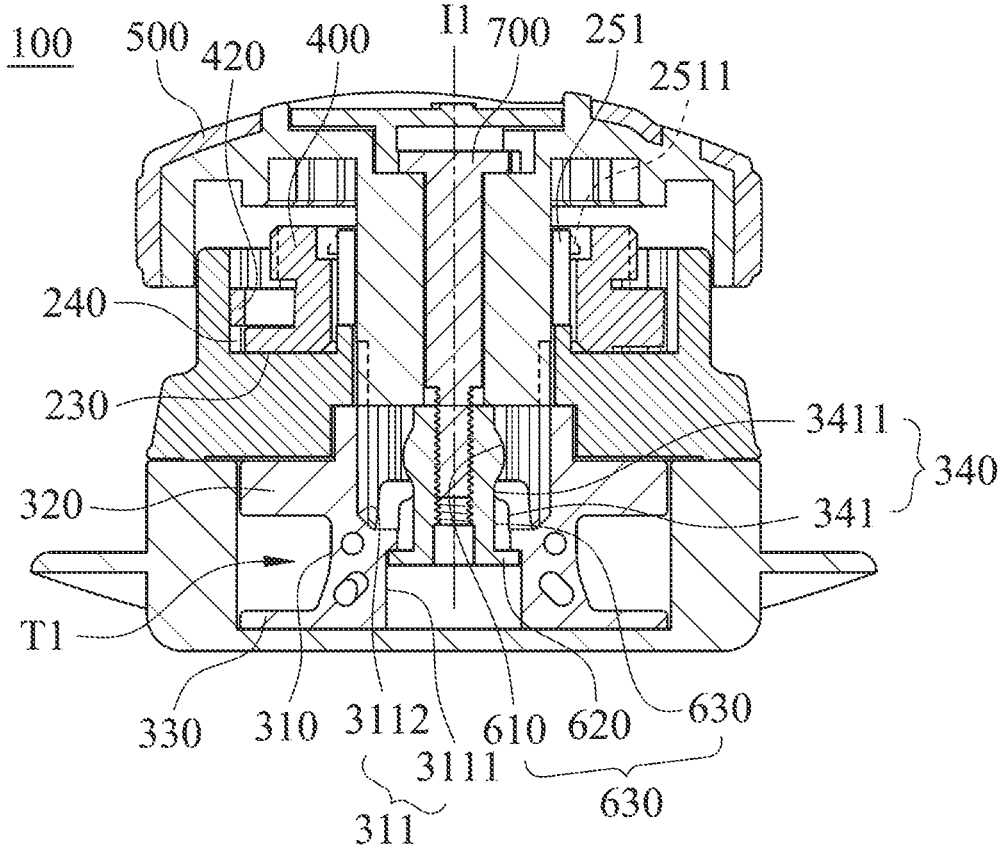
FIG. 5 shows another cross-sectional view of the fastening device of FIG. 1.

FIG. 1 shows a three dimensional schematic view of a fastening device 100 according to one embodiment of the present disclosure. FIG. 2 shows one exploded view of the fastening device 100 of FIG. 1. FIG. 3 shows another exploded view of the fastening device 100 of FIG. 1. FIG. 4 shows one cross-sectional view of the fastening device 100 of FIG. 1. FIG. 5 shows another cross-sectional view of the fastening device 100 of FIG. 1. As shown in FIG. 1 to FIG. 5, the fastening device 100 includes a case unit 200, a knob 500 and an engaging unit 400.

The case unit 200 includes a wall 220 forming a receiving space (not labeled) and a plurality of mounting teeth 240 located at the wall 220 and facing toward the receiving space. The knob 500 covers on the case unit 200. The engaging unit 400 is within the receiving space. The engaging unit 400 corresponds to the mounting teeth 240 and is selectively coupled to the knob 500. The knob 500 is switched between a first position and a second position along an axial direction 11. When the knob 500 is in the first position to couple to the engaging unit 400, the engaging unit 400 is linked up with the knob 500 and the engaging unit 400 is engaged with one of the mounting teeth 240 to prohibit the knob 500 from rotating in a first direction R1, and when the knob 500 is in the second position to disengage from the engaging unit 400, the engaging unit 400 does not prohibit the knob 500 from rotating in the first direction R1.

Hence, since the knob 500 is the only one which moves along the axial direction 11, and the engaging unit 400 is remained in the original position, the structure reliability is increased. The details of the fastening device 100 will be described in the following paragraphs.

The case unit 200 can include the wall 220, a partition 230 and the plurality of mounting teeth 240. The partition 230 protrudes radially from the wall 220 to separate the receiving space into an upper chamber S11 and a lower chamber S12. The engaging unit 400 is located at the upper chamber S11. To be more specific, the case unit 200 can further include a base 210, and the wall 220 can include an upper wall portion 221 and a lower wall portion 222. The lower wall portion 222 is affixed to the base 210, and the partition 230 is connected to a lower end of the upper wall portion 221. The wall 220 can further include four positioning portions 223 and four positioning holes 224. Each of the positioning portions 223 protrudes downward from the lower end of the upper wall portion 221. Each of the positioning holes 224 is located at the lower wall portion 222, and is configured to receive the positioning portion 223. After the positioning portions 223 are engaged with the positioning holes 224, the lower chamber S12 is formed by the base 210, the lower wall portion 222 and the partition 230, and the upper chamber S11 is formed by the upper wall portion 221 and the partition 230.

The case unit 200 can further include a limiting portion 250. The limiting portion 250 is located at the upper chamber S11 and connected to the partition 230. The limiting portion 250 limits the engaging unit 400. Through the configuration of the limiting portion 250, the engaging unit 400 can be limited in the upper chamber S11 and is prohibited from separating from the case unit 200. Preferably, the case unit 200 can include a through hole 260 located at the partition 230. The limiting portion 250 includes four limiting arms 251 spaced apart circumferentially around the through hole 260. Each of the limiting arms 251 has a free end 2511 configured to limit the engaging unit 400. The through hole 260 penetrating a center of the partition 230 along the axial direction 11 allows the lower chamber S12 to communicate with the upper chamber S11. The four limiting arms 251 protrude upward from a part of the partition 230, which is near the through hole 260, and form the free ends 2511 of lipped structure. Therefore, the engaging unit 400 can be put downward into the upper chamber S11 along the axial direction 11, and the four limiting arms 251 will be displaced so as to pass through a central hole (not labeled) of the engaging unit 400. After the engaging unit 400 is put into the upper chamber S11, the four limiting arms 251 are restored and the free ends 2511 limit the engaging unit 400 such that the engaging unit 400 is limited in the upper chamber S11.

The fastening device 100 can further include a spool 300 and a positioning shaft 600. The spool 300 is within the receiving space and includes a flexible clamping portion 340. The positioning shaft 600 is inserted into the spool 300 to couple to the flexible clamping portion 340. The positioning shaft 600 has the axial direction 11 and is linked up with the knob 500. When the knob 500 is in the first position to couple to the engaging unit 400, the engaging unit 400 is engaged with one of the mounting teeth 240 to prohibit the spool 300 from rotating in the first direction R1, and when the knob 500 is in the second position to disengage from the engaging unit 400, the engaging unit 400 does not prohibit the spool 300 from rotating in the first direction R1.

The spool 300 can include a hollow body 310, an upper ring portion 320 and a lower ring portion 330. The hollow body 310 includes an inner surface 311 forming a hollow space T2 configured for the positioning shaft 600 to inert therein. The upper ring portion 320 protrudes outward from one of two ends of the hollow body 310. The lower ring portion 330 protrudes outward from the other one of the two ends of the hollow body 310. A winding track T1 is formed between the upper ring portion 320 and the lower ring portion 330, and the flexible clamping portion 340 protrudes from the inner surface 311 toward the hollow space T2 to couple to the positioning shaft 600. In addition, the positioning shaft 600 can include a positioning protrusion 610. When the knob 500 is in the first position, the positioning protrusion 610 is located at one of two sides of the flexible clamping portion 340, and when the knob 500 is switched from the first position to the second position along the axial direction 11, the flexible clamping portion 340 is displaced by the positioning protrusion 610 such that the positioning protrusion 610 is switched to the other one of the two sides of the flexible clamping portion 340.

To be more specific, the inner surface 311 has an upper region 3112 and a lower region 3111. The upper region 3112 includes a vertical section (not labeled) and an inclined section (not labeled). The vertical section is connected to the inclined section, and the inclined section is connected to the lower region 3111. The flexible clamping portion 340 includes four clamping arms 341, and each of the clamping arms 341 protrudes from the inclined section toward the hollow space T2 to form a clamping end 3411 of lipped structure. The positioning shaft 600 can further include a base portion 620 and a shaft portion 630. The shaft portion 630 is disposed at the base portion 620, and the positioning protrusion 610 is located at the shaft portion 630. Hence, the positioning shaft 600 can be put upward into the hollow space T2 to engage with the flexible engaging portion 340, and the base portion 620 can be limited in the lower region 3111. The fastening device 100 can further include a screw member 700. The screw member 700 connects the positioning shaft 600 to the knob 500 such that the positioning shaft 600 is linked up with the knob 500.

When operation of the knob 500 causes the positioning shaft 600 to move upward along the axial direction 11, the positioning protrusion 610 pushes the four clamping arms 341 such that the four clamping arms 341 are displaced radially, and the positioning protrusion 610 can move from one of the two sides of the flexible clamping portion 340 to the other one of the two sides side of flexible clamping portion 340. Subsequently, the four clamping arms 341 are restored such that the knob 500 can remain in the second position.

The winding track T1 is configured for a lace (not shown) to wind thereabout. The case unit 200 can further include two lace holes 270. The two lace holes 270 are located at the lower wall portion 222, and the lace holes 270 can communicate with the lower chamber S12. Consequently, the lace can go out or drawn back into the lower chamber S12 to be released from or wound about the winding track T1 via the two lace holes 270.

The knob 500 can include a plurality of first driving teeth 540, and the engaging unit 400 can include a plurality of first combining teeth 410. When the knob 500 is in the first position, the first driving teeth 540 are engaged with the first combining teeth 410, and when the knob 500 is in the second position, the first driving teeth 540 are disengaged from the first combining teeth 410. Additionally, the knob 500 can further include a cap body 510 covering on the case unit 200, a post 520 disposed at the cap body 510 and protruding into the through hole 260, and a plurality of second driving teeth 530 located at a distal end of the post 520 to couple to the spool 300.

The cap body 510 of the knob 500 includes an inner top surface (not shown), and the post 520 protrudes downward from the inner top surface. The second driving teeth 530 are located at an outer surface of the post 520, and the first driving teeth 540 are located at the inner top surface and surround the post 520. The engaging unit 400 can include a hollow ring body 430, and the first combining teeth 410 are located at the top end of the hollow ring body 430. When the cap body 510 and the case unit 200 are assembled, the post 520 can protrude into the through hole 260 such that the second driving teeth 530 are engaged with a plurality of second combining teeth (not shown) which are located at the upper region 3112 to allow the knob 500 to couple to the spool 300.

In the embodiment, the engaging unit 400 can further include a plurality of pawl arms 420, and each of the pawl arms 420 protrudes outward from the hollow ring body 430. Each of the pawl arms 420 is engaged with at least one of the mounting teeth 240 in the first direction R1 to prohibit the engaging unit 400 from rotating in the first direction R1. On the other hand, each of the pawl arms 420 is disengaged from the mounting teeth 240 in a second direction R2 opposite to the first direction R1, and the engaging unit 400 is allowed to rotate in the second direction R2 relative to the case unit 200.

When the knob 500 is in the first position, as shown in FIG. 4, the first driving teeth 540 of the knob 500 are engaged with the first combining teeth 410 of the engaging unit 400, and the second driving teeth 530 of the knob 500 are engaged with the second combining teeth of the spool 300 such that rotation of the knob 500 by a user in the second direction R2 causes the pawl arms 420 to disengage from the mounting teeth 240, and the spool 300 can be linked up with the knob 500 to retract the lace. On the contrary, when the knob 500 is released by the user, each of the pawl arms 420 can engage with at least one of the mounting teeth 240, and rotation of the knob 500 is limited by the engaging unit 400. Meanwhile, rotation of the spool 300 in the first direction R1 is inhibited, and the lace is fastened.

When the user is looking forward to release the lace, as shown in FIG. 5, the knob 500 can be raised along the axial direction 11. The first driving teeth 540 of the knob 500 are disengaged from the first combining teeth 410 of the engaging unit 400, and the second driving teeth 530 of the knob 500 are disengaged from the second combining teeth of the spool 300. As a result, rotation of the knob 500 and the spool 300 are not inhibited by the engaging unit 400. In other embodiment, when the knob is in the second position, the engagement between the second driving teeth of the knob and the second combining teeth of the spool can be remained, but the present disclosure is not limited thereto.

Figure 6:
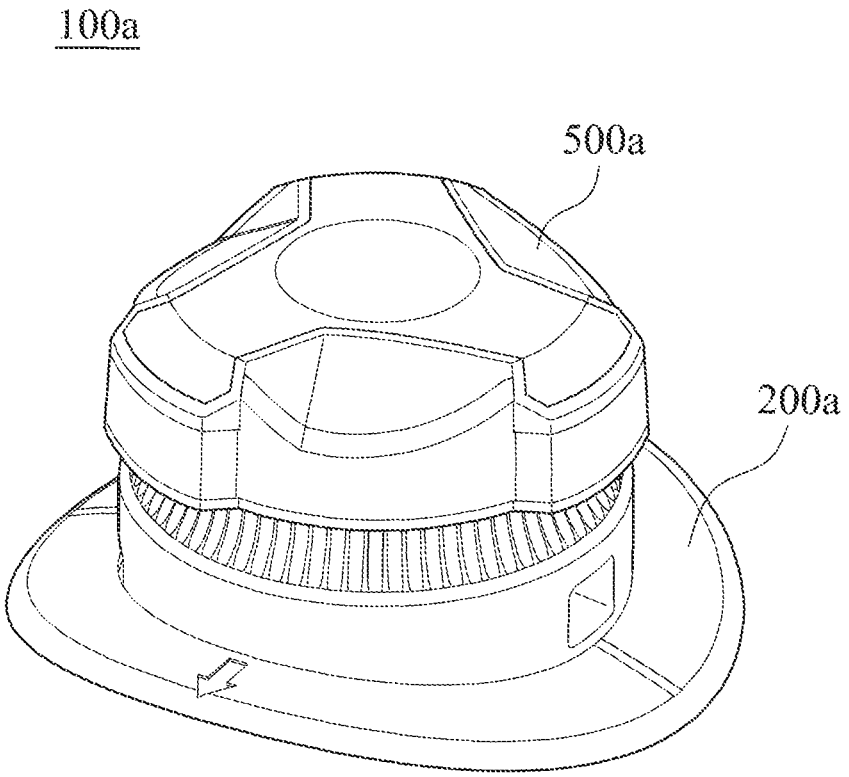
FIG. 6 shows a three dimensional schematic view of a fastening device according to another embodiment of the present disclosure.
Figure 7:
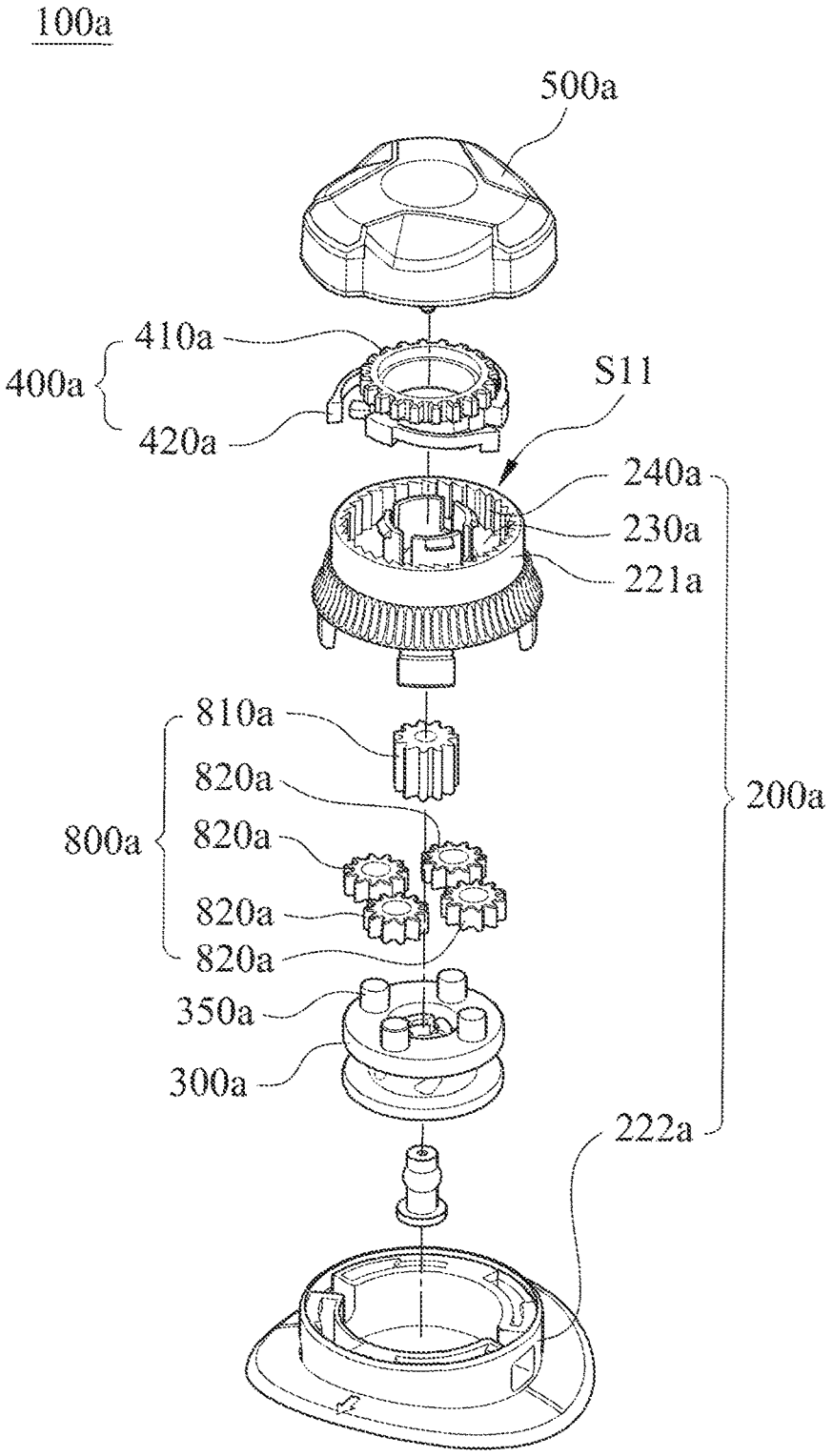
FIG. 7 shows one exploded view of the fastening device of FIG. 6.
Figure 8:
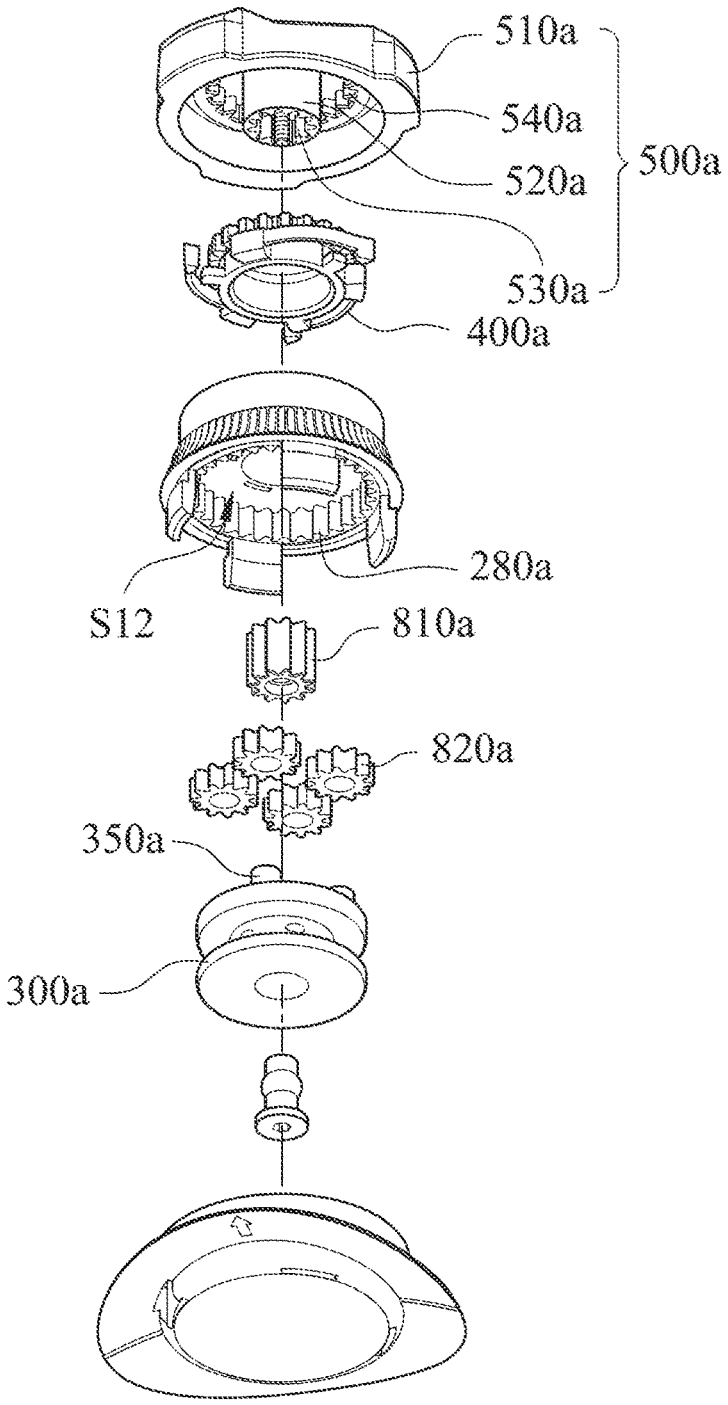
FIG. 8 shows another exploded view of the fastening device of FIG. 6.
Figure 9:
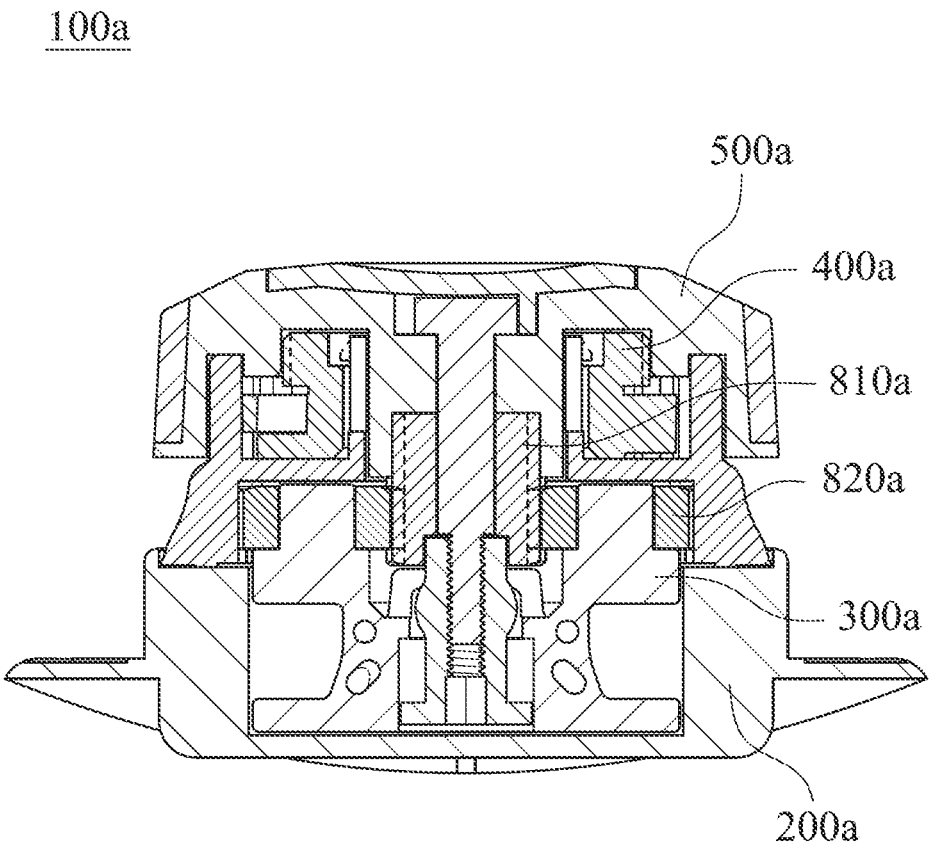
FIG. 9 shows one cross-sectional view of the fastening device of FIG. 6.
Figure 10:
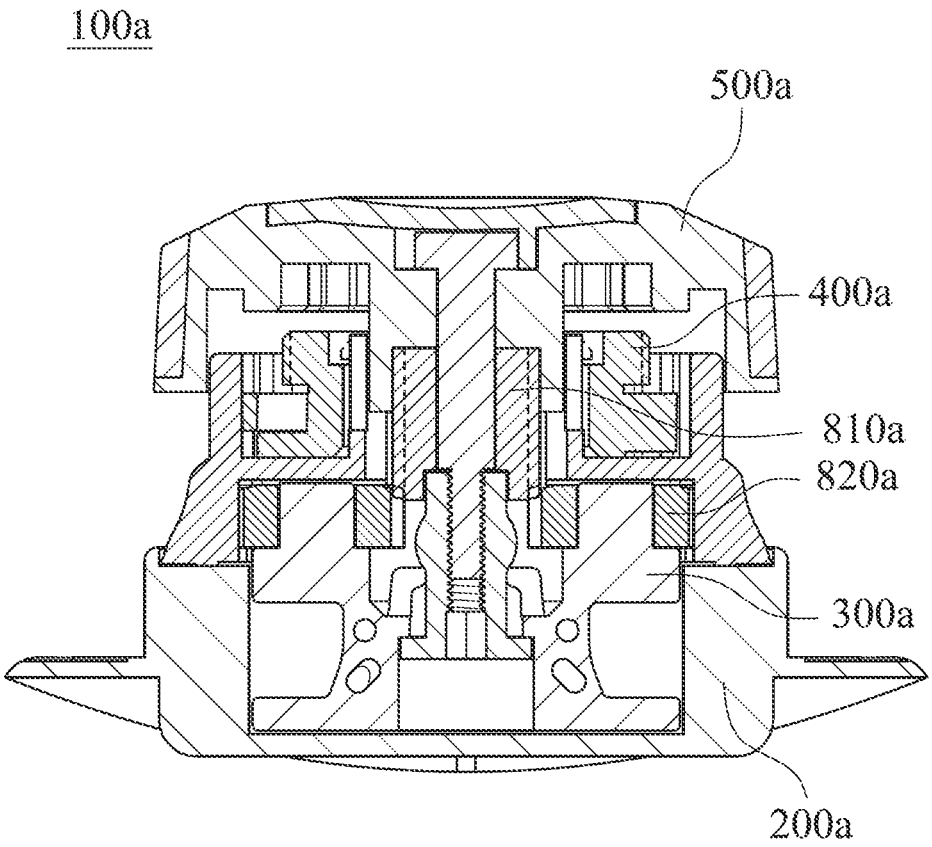
FIG. 10 shows another cross-sectional view of the fastening device of FIG. 6.

FIG. 6 shows a three dimensional schematic view of a fastening device 100*a* according to another embodiment of the present disclosure. FIG. 7 shows one exploded view of the fastening device 100*a* of FIG. 6. FIG. 8 shows another exploded view of the fastening device 100*a* of FIG. 6. FIG. 9 shows one cross-sectional view of the fastening device 100*a* of FIG. 6. FIG. 10 shows another cross-sectional view of the fastening device 100*a* of FIG. 6. The structure of the fastening device 100*a* is similar to the structure of the fastening device 100, but the spool 300*a* is coupled to the knob 500*a* in a different way.

To be more specific, the knob 500*a* can further include a cap body 510*a*, a post 520*a* and a plurality of second driving teeth 530*a*. The cap body 510*a* covers on the case unit 200*a*. The post 520*a* is disposed at the cap body 510*a* and protrudes into the through hole (not labeled), and the second driving teeth 530*a* are located at a distal end of the post 520*a*. The fastening device 100*a* further includes a gear assembly 800*a*, and the gear assembly 800*a* includes a sun gear 810*a* and a plurality of planetary gears 820*a*. The sun gear 810*a* is engaged with the second driving teeth 530*a*. A number of the planetary gears 820*a* is four in the embodiment, and the planetary gears 820*a* are spaced away from each other. Each of the planetary gears 820*a* is engaged with the sun gear 810*a*. The case unit 200*a* can further include a plurality of inner teeth 280*a* located at the lower chamber S12 and engaged with the planetary gears 820*a*.

The post 520*a* include a cave (not labeled) located at the distal end. The second driving teeth 530*a* are located within the cave. The sun gear 810*a* is engaged with the cave to engage with the second driving teeth 530*a*. The spool 300*a* includes four pivotal shafts 350*a* configured for the planetary gears 820*a* to be pivoted thereon. The partition 230*a* protrudes inwardly from a middle part of the upper wall portion 221*a*. The upper wall portion 221*a* can be deemed to be separated by the partition 230*a* such that the upper chamber S11 can be formed by the upper section of the upper wall portion 221*a*, and the lower chamber S12 can be formed by the lower section of the upper wall portion 221*a*, the lower wall portion 222*a* and the base (not labeled). The inner teeth 280*a* can be disposed within the lower section of the upper wall portion 221*a*. When the knob 500*a* is rotated, the sun gear 810*a* is driven by the second driving teeth 530*a*, and the planetary gears 820*a* will rotate and move along the inner teeth 280*a* to rotate the spool 300*a*.

Therefore, as shown in FIG. 9, when the knob 500*a* is in the first position, the first driving teeth 540*a* of the knob 500*a* are engaged with the first combining teeth 410*a* of the engaging unit 400*a*, and the second driving teeth 530*a* of the knob 500*a* are engaged with the gear assembly 800*a* such that rotation of the knob 500*a* by a user in a second direction causes the pawl arms 420*a* to disengage from the mounting teeth 240*a*, and the spool 300*a* can be linked up with the knob 500*a* to retract the lace. On the contrary, when the knob 500*a* is released by the user, each of the pawl arms 420*a* can be engaged with at least one of the mounting teeth 240*a*, and rotation of the knob 500*a* is limited by the engaging unit 400*a*. Meanwhile, rotation of the spool 300*a* in the first direction is inhibited, and the lace is fastened.

When the user is looking forward to release the lace, as shown in FIG. 10, the knob 500*a* can be raised along the axial direction. The first driving teeth 540*a* of the knob 500*a* are disengaged from the first combining teeth 410*a* of the engaging unit 400*a*, and rotation of the knob 500*a* and the spool 300*a* are not inhibited by the engaging unit 400*a*. Since the sun gear 810*a* is still coupled to the planetary gears 820*a*, the knob 500*a* is still coupled to the spool 300*a*.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure covers modifications and variations of this disclosure provided they fall within the scope of the following claims.

What is claimed is:

1. A fastening device, comprising:

a case unit, comprising:

a wall forming a receiving space;

a partition protruding radially from the wall to separate the receiving space into an upper chamber and a lower chamber; and a plurality of mounting teeth located at the upper chamber;

a spool located at the lower chamber and comprising a flexible clamping portion;

a positioning shaft inserted into the spool to couple to the flexible clamping portion, the positioning shaft having an axial direction;

a knob covering on the case unit and connected to the positioning shaft; and an engaging unit located at the upper chamber, the engaging unit corresponding to the mounting teeth and selectively coupled to the knob;

wherein the knob is switched between a first position and a second position along the axial direction, the positioning shaft is linked up with the knob, when the knob is in the first position to couple to the engaging unit, the engaging unit is engaged with one of the mounting teeth to prohibit the spool from rotating in a first direction, and when the knob is in the second position to disengage from the engaging unit, the engaging unit is engaged with one of the mounting teeth and does not prohibit the spool from rotating in the first direction.

2. The fastening device of claim 1, wherein the spool comprises:

a hollow body, comprising an inner surface forming a hollow space, wherein the hollow space is configured for the positioning shaft to inert therein;

an upper ring portion protruding outward from one of two ends of the hollow body; and a lower ring portion protruding outward from the other one of the two ends of the hollow body;

wherein a winding track is formed between the upper ring portion and the lower ring portion, and the flexible clamping portion protrudes from the inner surface toward the hollow space to couple to the positioning shaft.

3. The fastening device of claim 2, wherein the positioning shaft comprises a positioning protrusion, when the knob is in the first position, the positioning protrusion is located at one of two sides of the flexible clamping portion, and when the knob is switched from the first position to the second position along the axial direction, the flexible clamping portion is displaced by the positioning protrusion such that the positioning protrusion is switched to the other one of the two sides of the flexible clamping portion.

4. The fastening device of claim 1, wherein the case unit further comprises:

a limiting portion located at the upper chamber and connected to the partition, the limiting portion configured to limit the engaging unit.

5. The fastening device of claim 4, wherein the case unit further comprises a through hole located at the partition, the limiting portion comprises four limiting arms spaced apart circumferentially around the through hole, and a free end of each of the limiting arms is configured to limit the engaging unit.

6. The fastening device of claim 5, wherein the knob comprises a plurality of first driving teeth, the engaging unit comprises a plurality of first combining teeth, when the knob is in the first position, the first driving teeth are engaged with the first combining teeth, and when the knob is in the second position, the first driving teeth are disengaged from the first combining teeth.

7. The fastening device of claim 6, wherein the knob further comprises:

a cap body covering on the case unit;

a post disposed at the cap body and protruding into the through hole; and a plurality of second driving teeth located at a distal end of the post to couple to the spool.

8. The fastening device of claim 6, wherein, the knob further comprises:

a cap body covering on the case unit;

a post disposed at the cap body and protruding into the through hole; and a plurality of second driving teeth located at a distal end of the post;

the fastening device further comprises a gear assembly, wherein the gear assembly comprises:

a sun gear engaged with the second driving teeth; and a plurality of planetary gears spaced away from each other, each of the planetary gears engaged with the sun gear; and the case unit further comprises:

a plurality of inner teeth located at the lower chamber and engaged with the planetary gears.

9. A fastening device, comprising:

a case unit, comprising:

a wall forming a receiving space; and a plurality of mounting teeth located at the wall and facing toward the receiving space;

a knob covering on the case unit; and an engaging unit within the receiving space, the engaging unit corresponding to the mounting teeth and selectively coupled to the knob;

wherein the knob is switched between a first position and a second position along an axial direction, when the knob is in the first position to couple to the engaging unit, the engaging unit is linked up with the knob and the engaging unit is engaged with one of the mounting teeth to prohibit the knob from rotating in a first direction, and when the knob is in the second position to disengage from the engaging unit, the engaging unit is engaged with one of the mounting teeth and does not prohibit the knob from rotating in the first direction.

10. The fastening device of claim 9, further comprising:

a spool within the receiving space and comprising a flexible clamping portion; and a positioning shaft inserting into the spool and coupled with the flexible clamping portion, the positioning shaft having the axial direction and being linked up with the knob;

wherein when the knob is in the first position, the knob is coupled to the spool.

11. The fastening device of claim 10, wherein the spool comprises:

a hollow body, comprising an inner surface forming a hollow space, wherein the hollow space is configured for the positioning shaft to inert therein;

an upper ring portion protruding outward from one of two ends of the hollow body; and a lower ring portion protruding outward from the other one of the two ends of the hollow body;

wherein a winding track is formed between the upper ring portion and the lower ring portion, and the flexible clamping portion protrudes from the inner surface toward the hollow space to couple to the positioning shaft.

12. The fastening device of claim 11, wherein the positioning shaft comprises a positioning protrusion, when the knob is in the first position, the positioning protrusion is located at one of two sides of the flexible clamping portion, and when the knob is switched from the first position to the second position along the axial direction, the flexible clamping portion is displaced by the positioning protrusion such that the positioning protrusion is switched to the other one of the two sides of the flexible clamping portion.

* * * * *